US010094387B2

(12) United States Patent
Wuest et al.

(10) Patent No.: US 10,094,387 B2
(45) Date of Patent: Oct. 9, 2018

(54) TURBOCHARGER

(71) Applicant: Dr. Ing. h.c. F. Porsche Aktiengesellschaft, Stuttgart (DE)

(72) Inventors: Johannes Wuest, Bietigheim-Bissingen (DE); Maximilian Fischer, Tamm (DE)

(73) Assignee: DR. ING. H.C.F. PORSCHE AKTIENGESELLSCHAFT, Stuttgart (DE)

( * ) Notice: Subject to any disclaimer, the term of this patent is extended or adjusted under 35 U.S.C. 154(b) by 184 days.

(21) Appl. No.: 14/923,746

(22) Filed: Oct. 27, 2015

(65) Prior Publication Data

US 2016/0131147 A1 May 12, 2016

(30) Foreign Application Priority Data

Nov. 6, 2014 (DE) ..... 10 2014 116 160

(51) Int. Cl.
*F04D 27/00* (2006.01)
*F04D 25/02* (2006.01)

(52) U.S. Cl.
CPC ..... *F04D 27/001* (2013.01); *F04D 25/024* (2013.01)

(58) Field of Classification Search
None
See application file for complete search history.

(56) References Cited

U.S. PATENT DOCUMENTS 4,836,689 A 6/1989 O'Brian
6,364,524 B1 4/2002 Markham
9,039,353 B2 * 5/2015 Ramb ..... F01D 17/105 415/145
2009/0121706 A1 5/2009 Ante
2010/0140373 A1 6/2010 Myhre
2011/0069165 A1 3/2011 Zombo
2011/0229307 A1 * 9/2011 Lemieux ..... F01D 21/003 415/118
2014/0063227 A1 3/2014 Baleine

FOREIGN PATENT DOCUMENTS

EP 1 524 421 4/2005
EP 1524421 A1 * 4/2005 ..... F02B 37/12
JP H1164113 A 3/1999
KR 1020090007735 A 1/2009
KR 1020120064113 A 6/2012
KR 1020140107644 A 9/2014

OTHER PUBLICATIONS

German Search Report.

* cited by examiner

*Primary Examiner* — Logan Kraft
*Assistant Examiner* — Jason Fountain
(74) *Attorney, Agent, or Firm* — Gerald E. Hespos; Michael J. Porco; Matthew T. Hespos

(57) ABSTRACT

A turbocharger for an internal combustion engine has a housing (12) in which elements (18, 44) are arranged. An optical duct (24) is formed in the housing (12) and is assigned to at least one of the elements (18). The optical duct (24) is assigned an infrared detector (28) that is designed to detect infrared radiation (30) from the at least one element (18) through the optical duct (24) to determine a temperature (T) of the at least one element (18).

8 Claims, 3 Drawing Sheets

TURBOCHARGER

CROSS REFERENCE TO RELATED APPLICATION

This application claims priority under 35 USC 119 to German Patent Appl. No. 10 2014 116 160.2 filed on Nov. 6, 2014, the entire disclosure of which is incorporated herein by reference.

BACKGROUND

1. Field of the Invention

The invention relates to a turbocharger for an internal combustion engine. The turbocharger has a housing in which elements are arranged. An optical duct is in the housing and is assigned to at least one of the elements. The invention also relates to a method for measuring a temperature of an element of a turbocharger.

2. Description of the Related Art

Legal requirements and customer demands in the field of automotive engineering have given rise to internal combustion engines with reduced fuel consumption and with continuously increasing specific engine power. Increased power densities lead to an increase of the heat energy that is dissipated as heat losses from the combustion chamber into the cooling system, into the exhaust system and into the surroundings. This increased waste heat also increases the thermal load on numerous components of the internal combustion engine and of the exhaust system. Thus, elements such as pistons, valves, cylinder head, exhaust manifold and turbocharger are subjected to increased thermal load.

An increasing thermal load normally is counteracted by intensified cooling, structural measures and the use of higher-grade materials to ensure the reliability of engines and exhaust systems. Structural measures generally are less expensive. Higher grade materials are more expensive, but involve less outlay in terms of structural design.

The heating of particular elements in an engine must be taken into account in the development of internal combustion engines and turbochargers so that particular temperature limits are not exceeded. Any structural change may result in a change in the temperature of particular components during operation. Thus, a continuous direct measurement of the temperature of particular components is necessary in the development phase.

Mechanical and thermal loads of elements of the turbocharger, such as the turbine wheel, are difficult to determine in real operation, since there are no practicable measurement methods due to the high mechanical and thermal loads. Materials that allow conclusions to be drawn regarding the operating temperature on the basis of a change in material hardness cannot be used in the turbocharger due to high thermal loads. At present, only the exhaust gas temperature can be used as an indicator of the operating temperature of components of the turbocharger, and such measurements are inaccurate.

It is therefore an object of the invention to provide a turbocharger in which precise measurement of a temperature of an element under real conditions is possible. It is also an object of the invention to provide an improved method for measuring a temperature of an element of a turbocharger.

SUMMARY

The invention employs an optical duct and an infrared detector to detect infrared radiation from the at least one element through the optical duct to determine a temperature of the at least one element. More particularly infrared radiation of an element of the turbocharger arrangement is detected through an optical duct. The optical duct is formed in a housing of the turbocharger arrangement, and the temperature of the at least one element is determined on the basis of the infrared radiation.

The infrared detector and the optical enable measurement of the temperature of the element of the turbocharger to be carried out in contactless fashion. Thus, no redesign of the element that is to be measured is required, and a temperature measurement is possible under real conditions. Furthermore, the pyrometric measurement offers a high level of accuracy, a detection of rapid temperature changes and a large temperature range in which the temperature of the element can be determined. Thus, precise determination of the temperature of the element of the turbocharger is possible.

The optical duct may be a rectilinear duct with an opening at one axial end assigned to the at least one element. In this way, the infrared radiation of the at least one element can be detected precisely without the measurement being influenced by infrared radiation from other components of the turbocharger.

A transparent sealing element may be arranged in the optical duct to seal off the infrared sensor with respect to the at least one element in gas-tight fashion. In this way, elements of the turbocharger in regions with intensely fluctuating pressures can be measured with little technical outlay.

The infrared detector may have an optical element that is designed to focus the infrared radiation. In this way, the measurement accuracy can be improved because the infrared radiation is focused onto the infrared detector.

The optical element may be arranged in the optical duct. In this way, the measurement and the focusing of the infrared radiation can be performed close to the element that is to be measured so that the measurement can be more precise.

The optical duct may be connected to a gas duct of the turbocharger to detect the temperature of an element in the gas duct thereby measuring a temperature-critical region of the turbocharger that can otherwise be measured only indirectly.

The at least one element may be a turbine wheel of the turbocharger arrangement. In this way, a temperature-critical, movable element of the turbocharger arrangement can be measured precisely so that optimum development is possible.

A measurement spot of the infrared detector may be positioned through the optical duct to detect infrared radiation from an outer region of the turbine blade. Thus, a particularly critical region of the turbocharger can be measured, and correspondingly taken into consideration in structural design measures for temperature reduction.

The infrared detector may be connected optically to the optical duct by an optical conductor. In this way, the infrared detector can be installed separately from the turbocharger, and the entire measurement setup is not sensitive to thermal loads and contamination, and greater dynamics can be achieved.

The optical conductor may be arranged at least partially in the optical duct. Thus, disruptions of the infrared measurement can be avoided, as the optical conductor is arranged close to the element that is to be measured.

The optical duct may be a rectilinear tube and may have a gas-tight and fluid-tight shell surface. In this way, the optical duct can be arranged through coolant spaces in the turbocharger housing. Thus, an infrared measurement is possible even at poorly accessible locations in the turbocharger.

An inner surface of the optical duct may have a dark and/or matte coating to prevent optical reflections in the optical duct.

The optical duct may be surrounded by a cooling device. Thus, the optical duct and the optical components contained therein can be protected against high temperatures of the turbocharger arrangement.

The cooling device may be designed to supply a cooling fluid to the optical duct. Thus, the optical duct can be cooled in an effective manner with little technical outlay.

The turbocharger arrangement of the invention with the optical duct for infrared measurement enables a precise temperature measurement of particular elements of the turbocharger to be performed at any time during the development process to enable continuous checking of the thermal load of the elements of the turbocharger. The temperature measurement is performed by infrared measurement. Thus, it is possible for a large temperature range, rapid temperature changes and high absolute temperatures to be detected, without the need for increased outlay in terms of structural design for the corresponding elements that are to be measured. Finally, the infrared measurement enables a real measurement during engine operation so that checking of the thermal characteristics is possible under conditions close to reality.

It is self-evident that the features mentioned above and the features yet to be discussed below may be used in the respectively specified combination and also in other combinations or individually without departing from the scope of the invention.

Exemplary embodiments of the invention are illustrated in the drawing and will be discussed in more detail in the following description.

DETAILED DESCRIPTION

Figure 1:
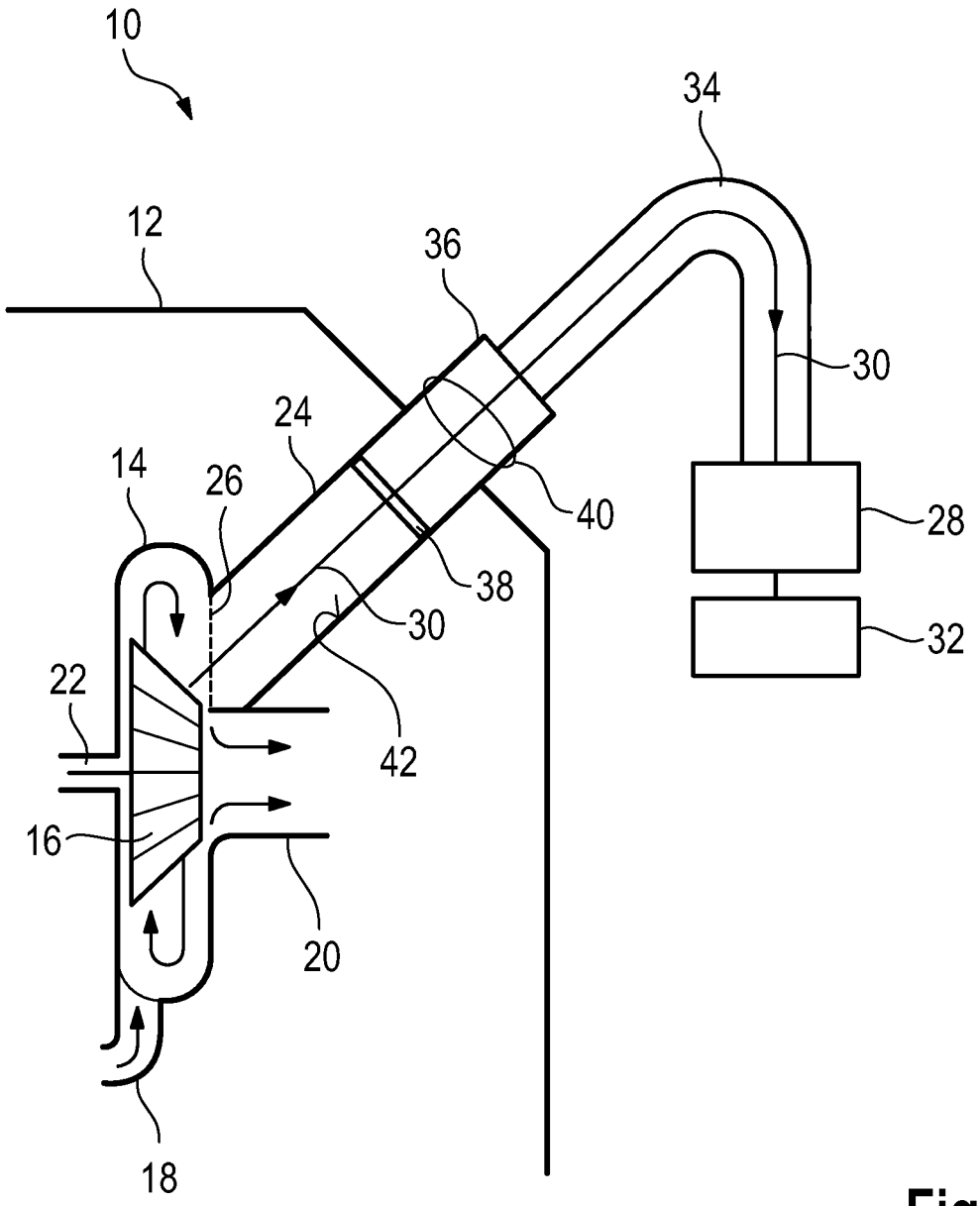
FIG. 1 is a schematic illustration of a turbocharger arrangement having an infrared measurement device for temperature measurement.

FIG. 1 is a schematic partial view of a turbocharger 10. The turbocharger 10 has a housing 12 that delimits the turbocharger 10 to the outside, and elements of the turbocharger 10 are accommodated in the housing 12. These elements warm up during operation.

The turbocharger 10 has a turbine housing 14 in which a turbine wheel 16 is accommodated. The turbine housing 14 is connected to a manifold 18 of an internal combustion engine (not illustrated) and to an exhaust system 20. Exhaust gas of the internal combustion engine is introduced through the manifold 18 into the turbine housing 14. The exhaust gas drives the turbine wheel 16 in the turbine housing 14, and the exhaust gas of the internal combustion engine is discharged from the turbine housing 14 via the exhaust system 20. The turbine wheel 16 is mounted rotatably and is connected by a shaft 22 to a compressor wheel (not illustrated) to generate a charge pressure for the internal combustion engine.

An optical duct 24 formed in the housing 12 of the turbocharger 10. The optical duct 24 has an opening 26 connected to the turbine housing 14 and assigned to the turbine wheel 16. The optical duct 24 is connected optically to an infrared detector 28 to detect infrared radiation 30 that is radiated from the turbine wheel 16. The infrared detector 28 is connected to a control unit 32 that controls the infrared detector 28 and determines a temperature of the turbine wheel 16 on the basis of the detected infrared radiation 30.

The optical duct 24 is connected by a glass fiber cable 34 to the infrared detector 28 to supply the infrared radiation 30 to the infrared detector 28. The glass fiber cable 34 is connected to the optical duct 24 at an end 36 opposite the opening 26 to receive and transmit the infrared radiation 30.

In an alternative embodiment, the infrared detector 28 is arranged directly on the end 36 of the optical duct 24, or is arranged in the optical duct 24 to detect the infrared radiation directly in or on the optical duct 24.

A glass element 38 is arranged in the optical duct 24 to protect the infrared sensor 28 and/or the glass fiber cable 34 against high exhaust-gas temperatures and soot particles in the turbine housing 14 and against the corresponding exhaust-gas back pressure. The glass element 38 preferably is sapphire glass. A focusing element 40 is in the optical duct 24 to focus the infrared radiation 30 and to supply the focused infrared radiation 30 to the glass fiber cable 34 and/or to the infrared detector 28.

The optical duct 24 may be a generally rectilinear duct or an elongate cylindrical tube, and the shell surface of which is gas-tight and fluid-tight to seal off the optical duct 24 with respect to the surroundings. Thus, the optical duct 24 can be led through existing coolant installations or the like of the turbocharger arrangement 10, without coolant passing into the optical duct 24. The optical duct 24 preferably is welded to the turbine housing 14.

The optical duct 24 is oblique to an axis of rotation of the turbine wheel 16 to permit a measurement of turbine blades of the turbine wheel 16. In this case, the optical duct 24 and the opening 26 are oriented so that the infrared radiation 30 is conducted from a measurement spot of the turbine wheel 16 into the optical duct 24, and the measurement spot is formed on a section of the turbine wheel 16 that is to be measured.

An inner surface 42 of the optical duct 24 may be provided with a black or dark coating and/or with a matte coating to prevent reflections on the inner surface 42.

The turbocharger 10, the optical duct 24 and the infrared detector 28 enable the temperature of the turbine wheel 16 to be detected reliably and precisely during engine operation so that a continuous and reliable determination of the temperature is possible.

The measurement arrangement with the optical duct 24 and the infrared detector 28 make it possible to measure temperatures of other elements in the turbocharger arrangement 10, for example of an inner surface of the turbine housing 14.

Figure 2:
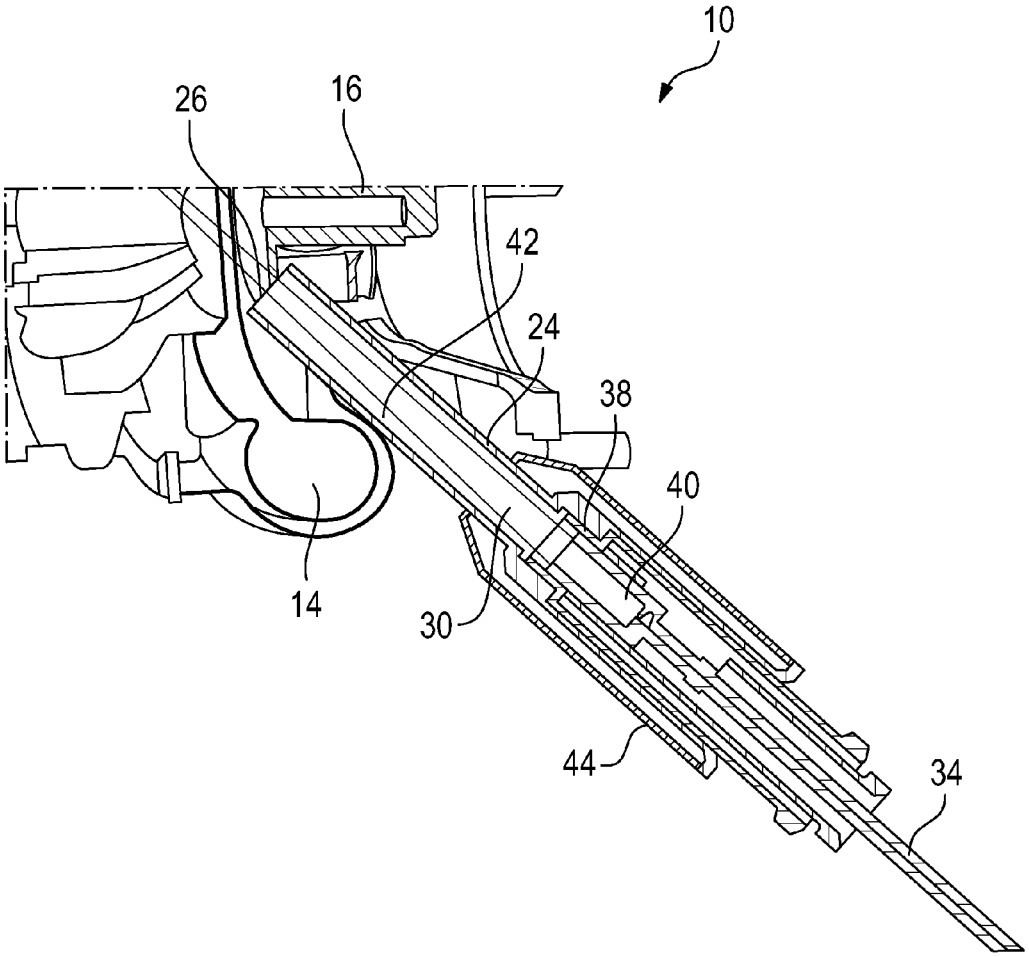
FIG. 2 is a perspective sectional view of a turbocharger arrangement having an optical duct for infrared temperature measurement.

FIG. 2 is a schematic perspective sectional view of the turbocharger 10 with the turbine housing 14. Identical elements are denoted by the same reference signs, with only the special features being discussed here.

The optical duct 24 is arranged in the turbocharger housing and is connected to the turbine housing 14 so that the opening 26 is directed toward the turbine wheel 16.

Thus, infrared radiation 30 from the turbine wheel 16 strikes the glass element 38 and is supplied by the focusing element 40 to the glass fiber cable 34 and to the infrared detector 28 (not illustrated here). In this embodiment, the opening 26 is directed toward blades of the turbine wheel 16 so that the infrared radiation of the blades of the turbine wheel 16 strikes the glass element 38 through the optical duct 24.

The end of the optical duct 24 opposite the opening 26 is surrounded by a cooling arrangement 44. Thus, the optical element, such as the glass element 38, the fixing element 40 and the glass fiber cable 34 can be cooled and protected against the high temperatures of the turbine housing 14. The cooling arrangement 44 is in the form of a cylindrical casing of the optical duct 24 and conducts a cooling fluid to an outer wall of the optical duct 24 so that the outer wall of the optical duct 24 can be cooled. The cooling arrangement 44 preferably is connected to a dedicated cooling circuit, as will be discussed in more detail below, so that continuous cooling can be provided.

Figure 3:
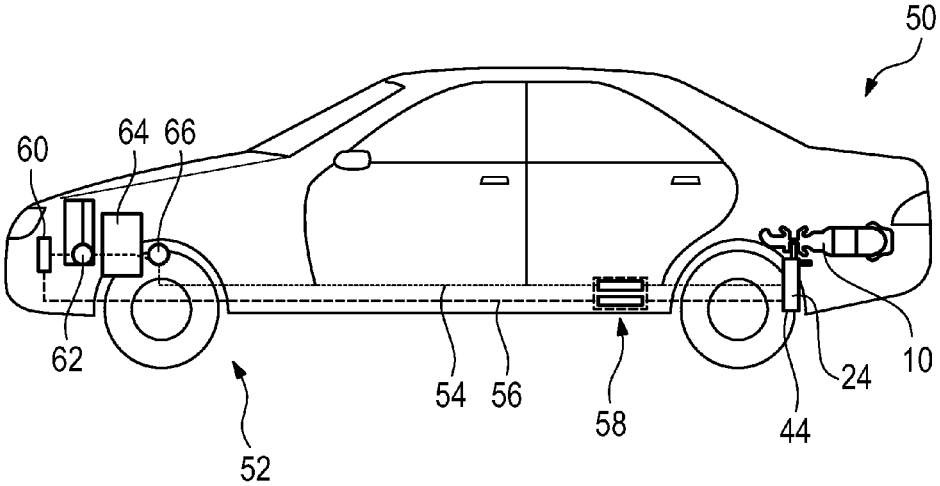
FIG. 3 is a schematic view of a motor vehicle having a cooling circuit for the cooling of the optical duct of the infrared measurement arrangement in the turbocharger.

FIG. 3 schematically illustrates a motor vehicle 50. The motor vehicle 50 has the turbocharger 10 with the infrared detector 28 and the optical duct 24 for measuring the temperature of an element of the turbocharger arrangement 10. The optical duct 24 has the cooling arrangement 44 connected to a dedicated cooling circuit 52.

The cooling circuit 52 has a feed line 54, a return line 56 and a temperature and pressure monitoring sensor 58 to monitor the temperature and the pressure in the feed line 54 and in the return line 56. The cooling circuit 52 also has a cooler 60, a throttle valve 62, a cooling water tank 64, a pump 66 and a heat exchanger. In this way, the cooling arrangement 44 can be supplied with cooling water in an effective manner, and the optical duct can be cooled reliably.

Figure 4:
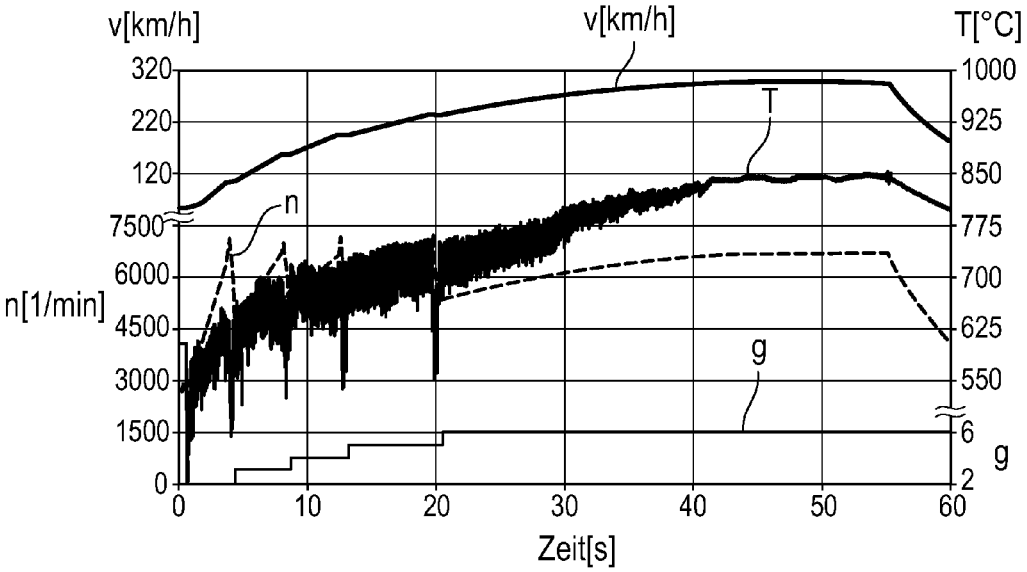
FIG. 4 shows a temperature profile of a turbine wheel of a turbocharger arrangement for different rotational speeds of an internal combustion engine.

FIG. 4 illustrates a temperature T of the turbine wheel 16 measured by the infrared detector 28, as a function of a rotational speed n of the internal combustion engine, a speed v of the motor vehicle, and a gear stage g of the motor vehicle.

As can be seen from FIG. 4, the temperature of the turbine wheel 16 fluctuates in a manner dependent on the rotational speed n of the internal combustion engine, and may fluctuate by up to 150° C. within very short time periods of less than one second, and may reach peak values of up to 850° C. at maximum speeds.

The temperature profile, as a function of the rotational speed n, the speed v and the engaged gear stage g, illustrates that a precise measurement of the temperature of the turbine wheel 16 is possible, and that, for the development of reliable and precise turbochargers, an exact measurement of the temperature T can be necessary or expedient.

Furthermore, from the high temperature gradients of the temperature T that can be measured during operation, it is evident that a dimensionless temperature measurement method based on the emitted thermal radiation offers a high level of precision even in the presence of steep temperature gradients with respect to time, and offers a broad measurement range.

Altogether, a precise measurement of the temperature of any desired elements of the turbocharger arrangement 10 is possible by way of the temperature measurement by means of the infrared detector.

What is claimed is:

1. A turbocharger for an internal combustion engine, having:

a turbine housing in which elements of the turbocharger are arranged;

an optical duct having opposite inner and outer ends, the inner end of the optical duct being in the turbine housing and aligned with at least one of the elements of the turbocharger, the outer end of the optical duct being external of the turbine housing;

a transparent sealing element in the optical duct between the inner and outer ends and seals the outer end of the optical duct relative to the inner end and the turbine housing;

an optical conductor extending from the outer end of the optical duct;

an infrared detector connected to an end of the optical conductor remote from the optical duct; and a cooling arrangement including a cooling casing surrounding areas of the cooling duct external of the turbine housing and defining part of a cooling circuit for directing a cooling fluid over an external surface of the cooling duct, wherein infrared radiation from the at least one element of the turbocharger is detected through the optical duct to determine a temperature of the at least one element.

2. The turbocharger of claim 1, wherein the transparent sealing element provides sealing between the inner and outer ends of the optical duct and seals off the infrared sensor with respect to the at least one element in gas-tight fashion.

3. The turbocharger of claim 1, wherein the infrared detector comprises an optical element designed to focus the infrared radiation.

4. The turbocharger of claim 3, wherein the optical element is arranged in the optical duct.

5. The turbocharger of claim 1, wherein the optical duct is connected to a gas duct of the turbocharger to detect the temperature of the at least one element in the gas duct.

6. The turbocharger of claim 1, wherein the at least one element is a turbine wheel of the turbocharger arrangement.

7. The turbocharger of claim 1, wherein the optical conductor is arranged at least partially in the optical duct.

8. The turbocharger of claim 1, wherein the optical duct is a rectilinear tube and has a gas-tight and fluid-tight shell surface.

* * * * *